US007557344B2

(12) United States Patent
Chernushevich et al.

(10) Patent No.: US 7,557,344 B2
(45) Date of Patent: Jul. 7, 2009

(54) CONFINING IONS WITH FAST-OSCILLATING ELECTRIC FIELDS

(75) Inventors: Igor Chernushevich, Toronto (CA); Alexandre Loboda, Toronto (CA)

(73) Assignees: MDS Analytical Technologies, a business unit of MDS Inc., Concord (CA); Applera Corporation, Framingham, MA (US)

( * ) Notice: Subject to any disclaimer, the term of this patent is extended or adjusted under 35 U.S.C. 154(b) by 183 days.

(21) Appl. No.: 11/774,807

(22) Filed: Jul. 9, 2007

(65) Prior Publication Data

US 2009/0014645 A1 Jan. 15, 2009

(51) Int. Cl.
*H01J 49/42* (2006.01)
*H01J 49/00* (2006.01)

(52) U.S. Cl. ..... 250/292; 250/293; 250/282; 250/281; 250/288

(58) Field of Classification Search ..... 250/292, 250/293, 282, 281, 288
See application file for complete search history.

(56) References Cited

U.S. PATENT DOCUMENTS

| | | | | |
|---|---|---|---|---|
| 5,576,540 | A | 11/1996 | Jolleffe | |
| 6,093,929 | A | 7/2000 | Javahery et al. | |
| 6,177,668 | B1 | 1/2001 | Hager | |
| 6,504,148 | B1 | 1/2003 | Hager | |
| 6,703,607 | B2 | 3/2004 | Stott et al. | |
| 7,026,613 | B2 * | 4/2006 | Syka | 250/292 |
| 7,071,464 | B2 * | 7/2006 | Reinhold | 250/282 |
| 7,227,130 | B2 | 6/2007 | Hager et al. | |
| 7,495,213 | B2 * | 2/2009 | Loboda | 250/292 |
| 2004/0195505 | A1 | 10/2004 | Bateman et al. | |
| 2004/0238734 | A1 | 12/2004 | Hager et al. | |
| 2005/0263695 | A1 | 12/2005 | Syka | |
| 2005/0263697 | A1 | 12/2005 | Hager et al. | |

FOREIGN PATENT DOCUMENTS

WO WO 2005/074004 8/2005

OTHER PUBLICATIONS

Wu et al., "Positive Ion Transmission Mode Ion/Ion Reactions in a Hybrid Linear Ion Trap", Analytical Chemistry 2004, 76, pp. 5006-5015 (10 pages).
McLuckey et al., "Atmospheric Sampling Glow-Discharge Ionization Source for the Determination of Trace Organic-Compounds in Ambient Air", Analytical Chemistry 1988, 20, pp. 2220-2227 (8 pages).
He et al., "Charge permutation reactions in tandem mass spectrometry", Journal of Mass Spectrometry, 2004; 39: pp. 1231-1259 (29 pages).
Syka et al., "Peptide and protein sequence analysis by electron transfer dissociation mass spectrometry", PNAS vol. 101, No. 26, pp. 9528-9533, Jun. 2004 (6 pages).

(Continued)

*Primary Examiner*—Nikita Wells
(74) *Attorney, Agent, or Firm*—Torys LLP

(57) ABSTRACT

The applicants' teachings provide methods, systems, and apparatus useful in operating mass spectrometers and other devices incorporating multipole rod sets or other multi-electrode devices to simultaneously contain ions of both positive and negative charges through the simultaneous application to the rods or other electrodes of both radio-frequency (RF) and alternating (AC) currents.

14 Claims, 4 Drawing Sheets

OTHER PUBLICATIONS

Xia et al., "Mutual Storage Mode Ion/Ion Reactions in a Hybrid Linear Ion Trap", Journal of American Society of Mass Spectrometry, vol. 16, pp. 71-81, 2005 (11 pages).

Printout from www.wikipedia.org, "Radio Frequency", <http://en.wikipedia.org/wiki/Radio_frequnecy>, accessed Jul. 19, 2006 (5 pages).

Printout from www.wikipedia.org, "Atomospheric electromagnetic transmittance or opacity.jpg", <http://en.wikipedia.org/wikillmage: Atmospheric_electromagnetic_transmittance_or_opacity.jpg, accessed Jul. 19, 2006 (3 pages).

Xia et al., "Pulsed Dual Electrospray Ionization for Ion/Ion Reactions", American Society for Mass Spectrometry 16, pp. 1750-1756, 2005 (7 pages).

McLuckey et al., "Ion Parking During Ion/Ion Reactions in Electrodynamic Ion Traps", Analytical Chemistry, vol. 74, No. 2, pp. 336-346, Jan. 15, 2002 (11 pages).

Dawson, "Quadrupole Mass Spectrometry and its Applications", AIP Press, Woodbury, New York, 1995 pp. 210-217 (8 pages).

Collings et al., "Resonance Shifts in the Excitation of the n = 0, K = 1 to 6 Quadrupole resonances for Ions Confined in a Linear Ion Trap", Journal Am. Soc. Mass. Spectrom 2002, 13, pp. 577-586 (10 pages).

Londry et al., "Mass Selective Axial Ion Ejection from a Linear Quadrupole Ion Trap", 2003 American Society for Mass Spectrometry, Published by Elsevier Inc. 1044-0305/03, pp. 1130-1147 (18 pages).

PCT International Search Report and Written Opinion for International Application No. PCT/CA2008/001170 mailed Oct. 2, 2008 (8 pages).

* cited by examiner

CONFINING IONS WITH FAST-OSCILLATING ELECTRIC FIELDS

FIELD

The applicants' teachings relate to mass spectrometry.

INTRODUCTION

It is advantageous in conducting some types of analysis using mass spectrometers and other devices to simultaneously trap ions of both positive and negative polarity within a single volume and have them react with each other. Such methods of analysis include, for example, electron transfer dissociation (ETD) and proton or electron transfer reactions.

Some success in simultaneously trapping ions of both positive and negative polarity in linear ion traps (LITs) has been achieved by applying a radio-frequency (RF) alternating current (AC) voltage at both the entrance and exit of the LIT. See J. Syka et al., "Peptide and Protein Sequence Analysis by Electron Transfer Dissociation Mass Spectrometry," PNAS vol. 101, no. 26, p 9528-9533, Jun. 2004. See also WO 2005/074004. A disadvantage to this approach, however, is that the application of RF fields to the ends of the LIT causes the fields to extend into the regions of adjoining elements of the spectrometer, for example, apertures, lenses, mass analyzers, or additional rod sets. This can cause, for example, difficulties in manipulating ions in the affected adjoining elements.

Another approach to the simultaneous trapping of ions of both positive and negative polarity in linear ion traps (LITs) is to apply unbalanced main RF voltages applied to rod sets in multipole devices. See Y. Xia et al., "Mutual Storage Mode Ion/Ion Reactions in a Hybrid Linear Ion Trap," Journ. Amer. Society of Mass Spectrometry, Vol. 16, p. 71, 2005. The authors of the Xia publication acknowledge, however, that this approach provides limited success: as noted, for example, at page 73, "[t]he unbalanced [RF voltage] condition creates a barrier for transmission out of Q3 as well as into Q2. Presumably for this reason, transfer of anions from Q3 to Q2 was found to be highly inefficient." Another limitation of this approach is that the effective potential barrier created by unbalanced RF voltages is relatively small and not easily controllable.

SUMMARY

The applicant's teachings provide methods, systems, and apparatus useful in operating mass spectrometers and other devices incorporating multipole rod sets or other multi-electrode devices to simultaneously contain ions of both positive and negative charges through the simultaneous application to the rod electrodes or other electrodes of both radio-frequency (RF) and alternating current (AC) voltages.

In one aspect, the applicant's teachings provide methods useful, for example, in operating a mass spectrometer having an elongated multipole rod electrode set, the electrode set comprising a plurality of electrodes disposed in opposition to each other so as to define a region between, or bounded by, the electrodes. Such methods can comprise providing a radio-frequency (RF) voltage to at least two of the electrodes; providing an alternating current (AC) voltage to the rod set in addition to the RF voltage, the AC frequency being the same as or lower than the RF frequency, and being applied in a substantially single phase and at substantially uniform voltage to all rods of the rod set; and providing ions of opposite polarity within the region bounded by the rod set.

In another aspect, the applicant's teachings provide mass spectrometers or mass spectrometer systems. Such a mass spectrometer and/or mass spectrometer system can comprise a multipole rod electrode set comprising a plurality of opposing electrode sets; a radio-frequency (RF) voltage supply connected to at least two of the opposing electrode sets; and an alternating current (AC) voltage supply connected to the electrode sets; wherein the AC and RF voltage supplies are independently controllable and the AC voltage supply is configured to provide a substantially single-phase AC voltage of substantially uniform magnitude to the electrode sets.

In some embodiments, multipole electrode sets in accordance with applicant's teachings comprises a plurality of electrode pairs; that is, 2N electrodes, where N is an integer greater than one. In such embodiments an RF voltage can be applied in a first phase to every second rod and in an opposite phase to the remaining rods.

In the same and other embodiments, the AC and RF power supply(ies) can be adapted for independent control of frequencies and voltages of supplied power. Control may be by manual or automatic means, using for example a suitably-configured controller coupled to the power supply(ies).

Such methods and systems provide a number of advantages useful in the analysis of ions and other substances, and greatly increase the analytic possibilities available through many types of known mass spectrometers. Doubtless, too, new and as-yet unsuspected applications will be developed for implementation using both currently-available and as-yet undeveloped MS devices.

BRIEF DESCRIPTION OF THE FIGURES

The applicants' teachings are illustrated in the figures of the accompanying drawings which are meant to be exemplary and not limiting, in which like references are intended to refer to like or corresponding parts, and in which.

DESCRIPTION OF VARIOUS EMBODIMENTS

Figure 1A:
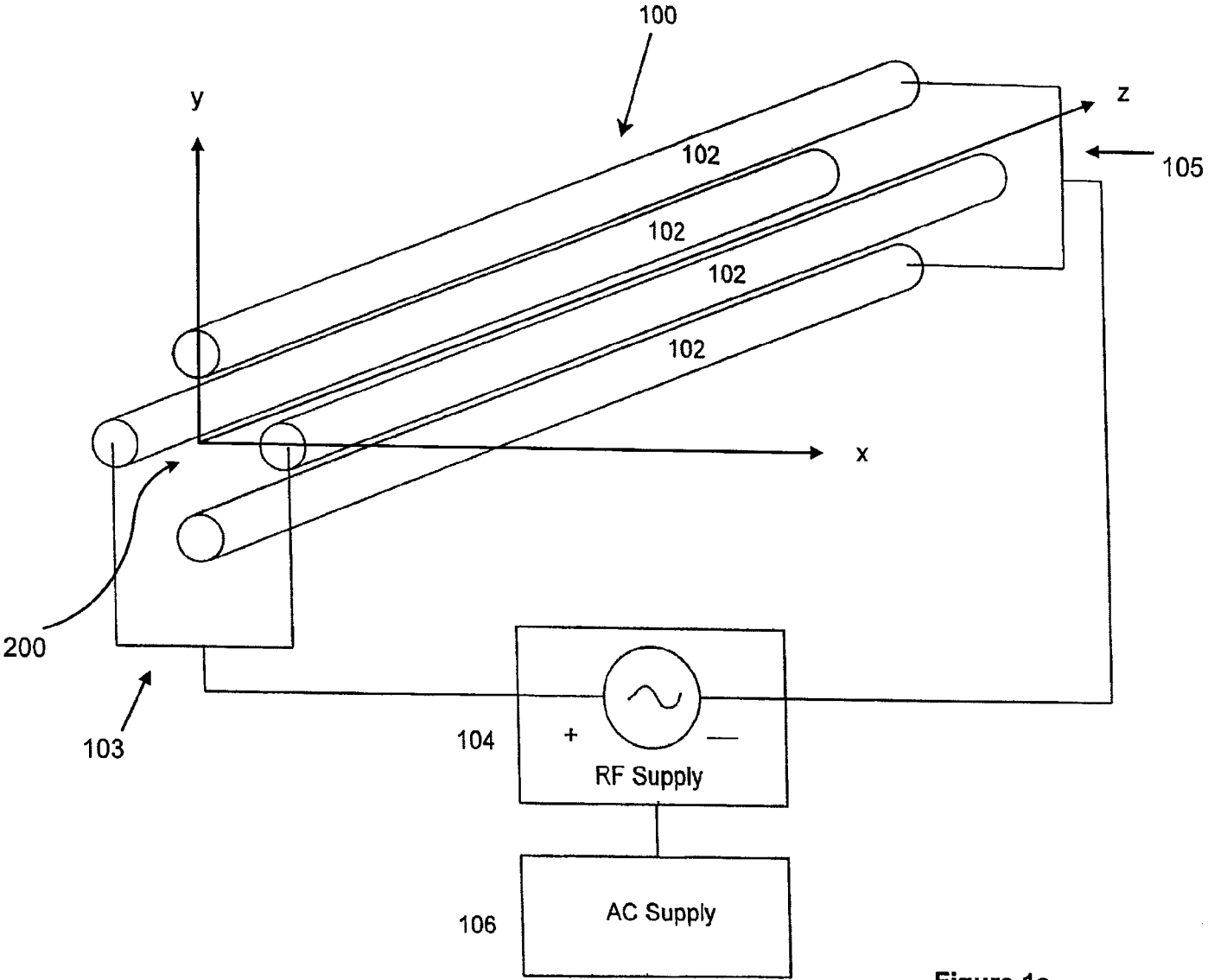
FIGS. 1*a* and 1*b* are schematic representations of multipole rod sets and associated wiring configurations, suitable for use in implementing embodiments of applicants' teachings.
Figure 1B:
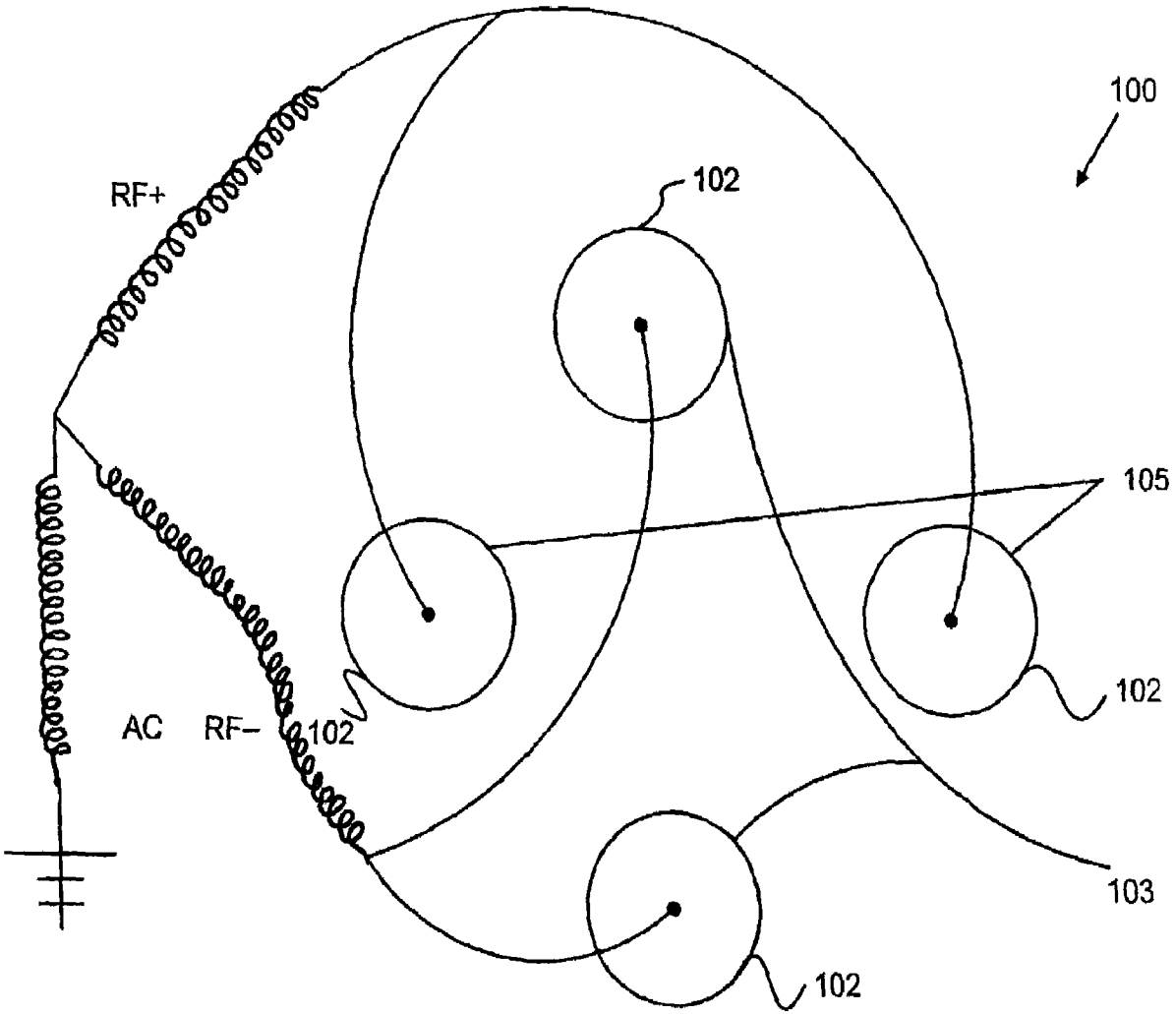

FIGS. 1*a* and 1*b* are schematic representations of multipole rod electrode sets suitable for use in implementing the applicants' teachings.

In FIG. 1*a*, rod electrode set 100 comprises a plurality of rod-shaped electrodes ("rods") 102 electrically connected to RF power supply 104 and AC power supply 106. In the example shown, the plurality of rods 102 comprises 2N rods, where N is 2, and the 2N rods are disposed in opposing sets.

As will be understood by those of ordinary skill in the relevant arts, once they have been made familiar with this disclosure, a wide variety of multipole configurations are suitable for use in implementing applicants' teachings. In particular, it will be understood that rod electrode set 100 may comprise any even number of rods greater than 3. Many rod electrode sets suitable for use in implementing applicants' teachings are commercially available today, the quadrupole arrangements such as that shown in FIG. 1*a* being perhaps the most common. Other configurations comprise 6 or more rods, where every other rod is connected to one end of RF voltage supply, and the rest are connected to another end of RF supply.

Electrode set 100 may in general comprise any number of rods capable of providing electromagnetic (e.g., RF and AC) fields capable of restraining ions from movement within the X-Y directions shown in FIG. 1*a*. For example, it will be readily understood by those skilled in the relevant arts that while in some ways it may be easiest to conceptualize and implement systems comprising even numbers of electrodes, in other embodiments odd numbers of electrodes may be used. In such embodiments, as will be understood by those skilled in the relevant arts, appropriately-distributed phasing of RF and AC voltages across the electrodes may be used instead of simple opposite phasing.

As will be understood by those skilled in the relevant arts, ions provided by an ion source may be introduced to the region 200 bounded by the rod electrode set 100. It has long been understood that, through the application of suitable RF voltages to the two rod pairs 103, 105 for radial confinement (i.e., restraint from leaving the region 200 in the X-Y coordinate directions), and suitable DC voltages to the entrance and exit lenses (not shown), ions of a single polarity (i.e., positive or negative, cation or anion) introduced at region 200 may be contained within the region 200 bounded by the rod electrode set and induced to traverse the length of the rod set in an axial direction generally corresponding to the axis Z. The applicants have determined that the addition of an AC voltage superimposed upon such RF voltage in, for example, the manner shown in FIGS. 1*a* and 1*b* may be used to successfully contain ions of both polarities (i.e., cations and anions) within the region 200 bounded by the electrode set. Application of an AC voltage creates an effective potential $V_{eff}$ that confines ions axially. According to Gerlich (Dieter Gerlich, "Inhomogeneous RF Fields: a Versatile Tool for the Study of Processes with Slow Ions", in State-selected and state-to-state ion-molecule reaction dynamics, Part 1, Edited by Cheuk-Yiu Ng and Michael Baer, Advances in Chemical Physics, v.LXXXII, John Wiley & Sons, 1992), if an oscillating electric field is applied with an amplitude E(R) and an angular frequency Ω, the effective potential can be calculated as $$V_{eff}=qE^2(R)/4m\Omega \quad \text{(Eq. 1)}$$

where q and m are the charge and mass of an ion within the field. Since the sign of the effective potential is the same as that of the ion charge, ions of both polarities can be confined by the same effective potential barrier created by applied AC voltage. On the other hand, since the effective potential depends on the electric field rather than the AC voltage amplitude, the same effective potential barrier can be created to confine ions axially no matter whether AC voltage is applied to the rod set 100 or to the adjacent electrodes as taught by Syka et al., 2004. A difference between Syka's approach and that disclosed herein is that in the method proposed here the AC field is localized and does not spread to the rest of the system.

In the embodiment shown in FIG. 1*a*, RF power supply 104 applies RF current to the four poles 102 of rod set 100, the RF current being applied in opposite phases to the two rod pairs 103, 105 (as indicated by the use of (+) and (−) symbols).

In order to provide for the simultaneous containment within region 200 inside rod set 100 of ions of both polarities (i.e., cations and anions), AC power supply 106 of FIG. 1*a* is, as shown, adapted to provide an AC voltage of a single phase to all rods 102 of rod set 100, so that rod pairs 103, 105 are provided with an AC voltage of the same phase superimposed upon RF current of opposite phases provided by power supply 104.

For purposes of clarity, power supplies 104, 106 are shown in FIG. 1*a* as separate devices; however, they may, as will be understood by those skilled in the relevant arts, be provided by a single, suitably-configured power supply unit. In general, power supply(ies) 104, 106 can be adapted to provide any one or more of direct current (DC), alternating current (AC), and/or radio-frequency (RF) current voltages to one or more of electrodes 102 in implementing embodiments of applicants' teachings.

An alternative scheme for showing the same resultant superimposed uniform phase AC power and opposite-phase RF power is shown schematically in FIG. 1*b*.

As shown in Equation 1, the strength of the effective potential barrier is inversely proportional to the mass of the ion. In other words, heavier ions experience a smaller effective barrier. It is therefore necessary to adjust the AC voltage amplitude depending on the mass range of ions to be trapped.

The applicants have ascertained that the application of voltages and frequencies in the manner described herein can induce "saddle-shaped" effective potential fields within the region 200 of rod set 100, comprising generally lower potentials in the middle of the rod set than near the ends. It has been observed that the combination of RF and AC fields tends to push ions of both charge states toward center of rod set, in both the axial and radial directions (i.e., in all three x, y, z coordinate directions in FIG. 1*a*), so that they may be contained simultaneously within the single volume inside the rod set.

As is generally understood by those skilled in the relevant arts, radio-frequency currents are AC currents having frequencies higher than about 10,000 cycles per second (cps), or Hertz (Hz). The applicants' teachings have provided improved results, in implementing initial versions of systems in accordance therewith, by applying RF currents in the range of about 10,000 Hz to about 100 mega-Hz (Mhz), and AC currents at frequencies of approximately one-half (½) the frequency of applied RF currents. The applicants have observed, for example, that applying AC and RF frequencies at ratios of approximately one to two (½) can reduce the presence of 'holes' in spectra of the resultant cation-anion containment fields, thus improving the containment of ions of both positive and negative charge states.

As will further be apparent to those of ordinary skill in the relevant arts, once they have been made familiar with this disclosure, the application of AC and RF voltages as described herein may also be used in conjunction with gas pressures, such as those typically provided within collision chambers, separation orifices, and other portions of mass spectrometers as described herein, to assist with the containment and control of ions.

Examples of currently-available MS devices within which the applicants' teachings can be advantageously implemented include quadrupole, TOF (including QqTOF and other ortho-TOF systems), and linear ion trap mass spectrometers. In general, any MS device in which multipole elements are employed, and particularly those in which it is anticipated or desired to contain or otherwise manipulate ions of both positive and negative polarity simultaneously, is suitable for use in implementing the applicants' teachings. Examples of suitable MS devices currently commercially available include the API™, QTrap® and QStar® systems available through Applied Biosystems/MDS Sciex.

Figure 2:
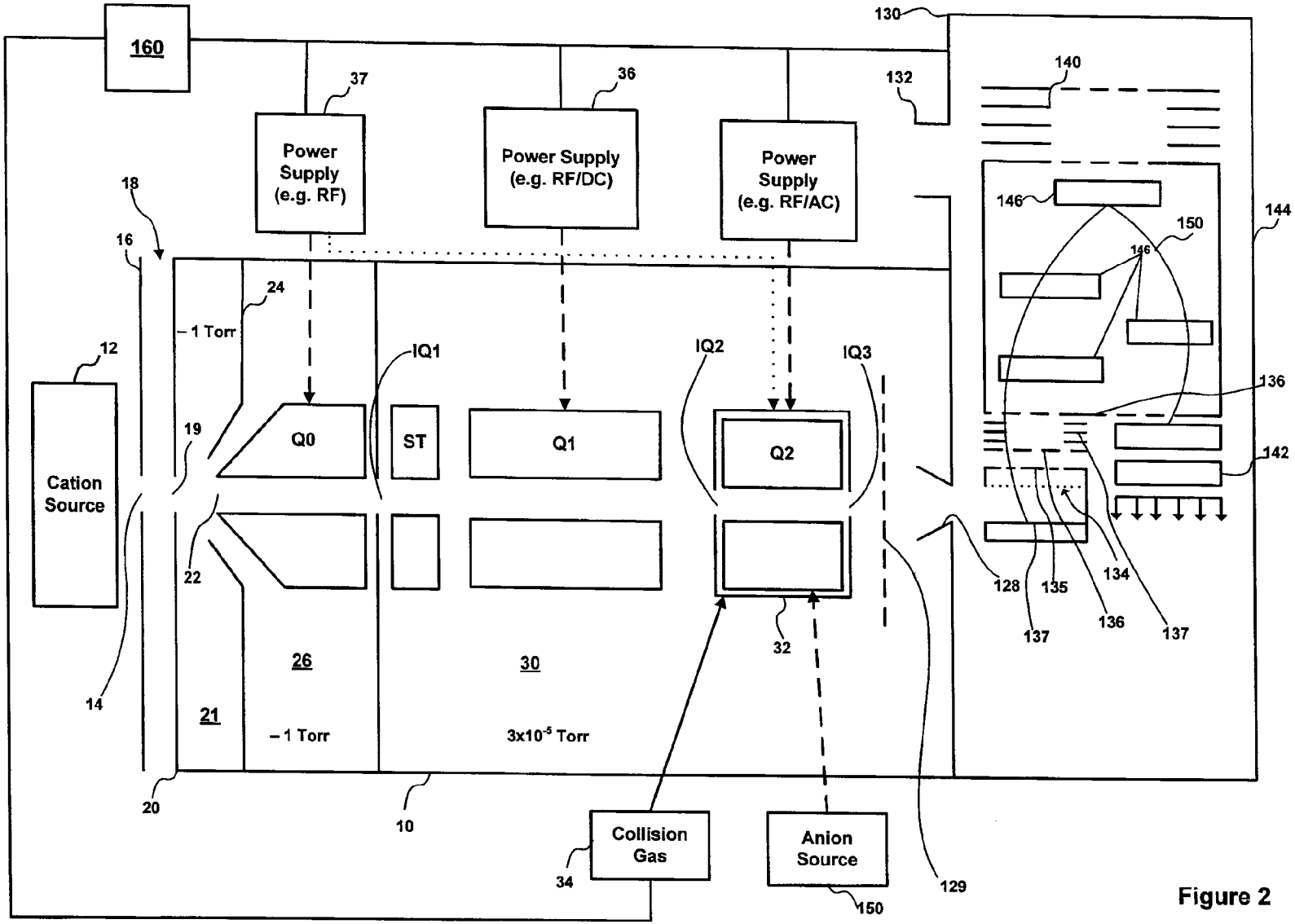
FIGS. 2 and 3 are system block diagrams of mass spectrometers suitable for use implementing embodiments of applicants' teachings.
Figure 3:
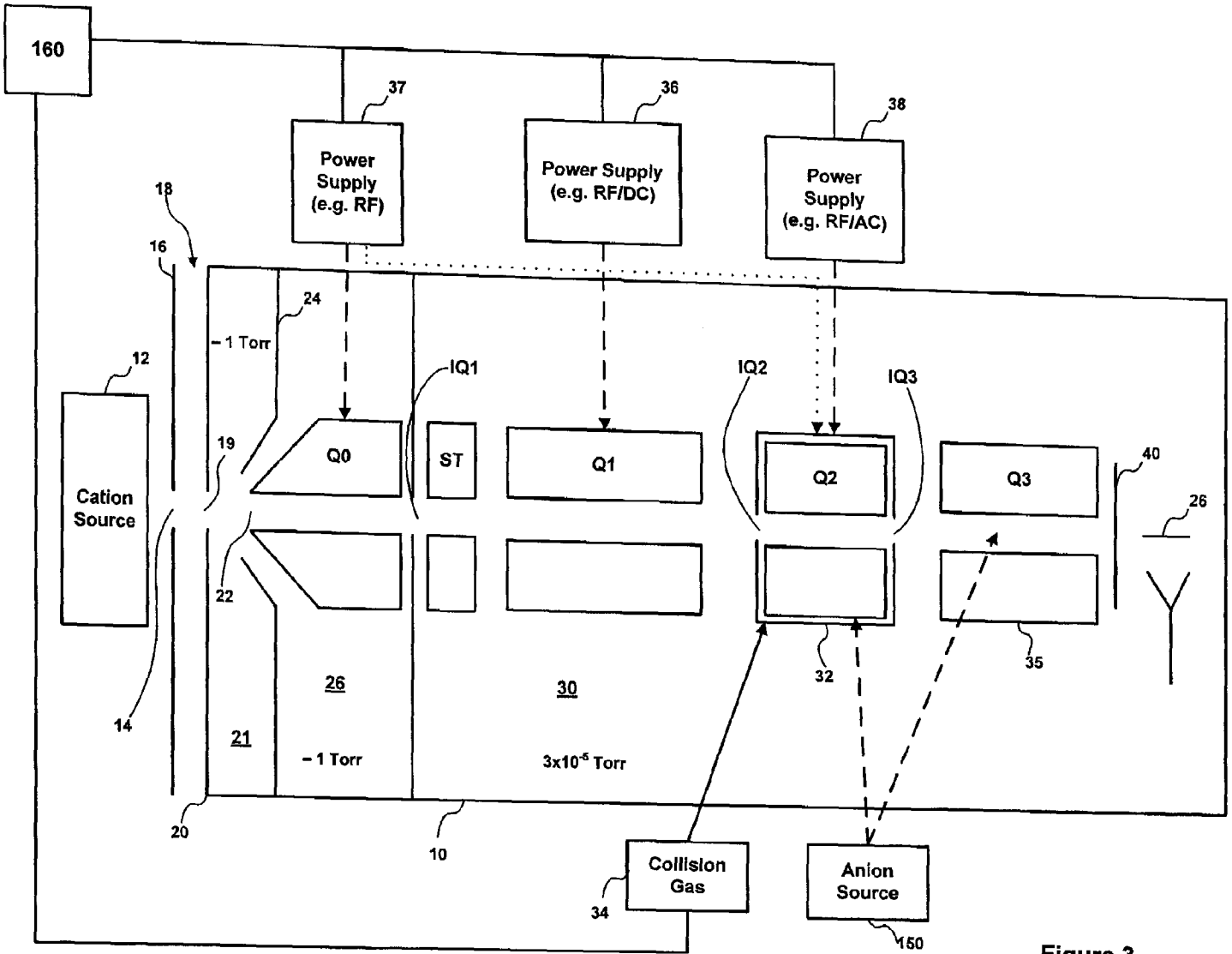

FIGS. 2 and 3 are system block diagrams of mass spectrometers 10, 10' suitable for use implementing the applicants' teachings. Mass spectrometers 10, 10' shown in FIGS. 2 and 3 comprise QqTOF and triple quadrupole configurations respectively.

Each of mass spectrometers 10, 10' in the embodiments shown in FIGS. 2 and 3 comprises a cation (positive ion) or anion (negative ion) source 12, which may include, for example, an electrospray, ion spray, liquid chromatography (LC) or corona discharge device, or any other known or subsequently-developed source suitable for use in implementing the applicants' teachings. A wide variety of suitable ion sources are now commercially available, and doubtless others will be developed later. Examples of suitable sources now available include the IonSpray™, Turbo V™, DuoSpray™, NanoSpray®, and PhotoSpray® devices available through Applied Biosystems/MDS Sciex.

Ions from source 12 may be directed through aperture 14 in aperture plate 16 and into a curtain gas chamber 18. Curtain gas chamber 18 may be supplied with curtain gas such as argon, nitrogen, or other, preferably inert, gas from a gas source (not shown). Suitable methods for introduction and employment of curtain gas and curtain gas chamber 18 are known.

Ions may be passed from curtain gas chamber 18 through orifice 19 in orifice plate 20 into differentially-pumped vacuum chamber 21. As will be understood by those of ordinary skill in the relevant arts, the use of curtain gas chamber 18, electric fields and differential gas pressures within chambers 18, 21 may be used to cause desired sets of ions emitted by source 12 to move through mass spectrometer 10' in a desired manner. Such ions may then be passed through aperture 22 in skimmer plate 24 into a second differentially-pumped vacuum chamber 26. Typically, in traditionally-implemented systems, the pressure in chamber 21 is maintained at the order of 1 or 2 Torr, while the pressure in chamber 26, which in the past has often described as the first chamber of the mass spectrometer proper, is evacuated to a pressure of about 7 or 8 mTorr.

In chamber 26, there may be provided a multipole rod set Q0, 100, which may be configured for use as a conventional RF ion guide. A number of varieties of ion guides are now being provided, some or all of which may, as will be understood by those of ordinary skill in the relevant arts, once they have been made familiar with this disclosure, be suitable for use in implementing the applicants' teachings. Ion guide rod set Q0 may serve, for example, to cool and focus the stream of ions present within the mass spectrometer, and may be assisted in such functions by the relatively high gas pressures present within chamber 26. Chamber 26 also serves to provide an interface between ion source 12, which may typically operate at atmospheric pressures, and the lower-pressure vacuum chambers 21, 26, thereby serving to control gas received from the ion stream, prior to further processing.

In the embodiments shown in FIGS. 2 and 3, an interquad aperture IQ1 provides for ion flow from chamber 26 into a second main vacuum chamber 30. In second chamber 30, there may be provided RF-only multipole rod set 100 (labeled ST, for "stubbies", to indicate rods of short axial extent), which can for example serve as Brubaker lenses.

Multipole rod set 100, Q1 may also be provided in vacuum chamber 30, which may be evacuated to approximately 1 to $3\times10^{-5}$ Torr. Chamber 30 may also be provided with a second multipole rod set 100, Q2 in a collision cell 32, which may be supplied with collision gas at 34, and may be designed to provide an axial field biased toward the exit end as taught for example by Thomson and Jolliffe in U.S. Pat. No. 6,111,250. Cell 32 may be provided within the chamber 30 and may include interquad apertures IQ2, IQ3 at either end. In traditionally-implemented systems, cell 32 is typically maintained at a pressure in the range $5\times10^{-4}$ to $8\times10^{-3}$ Torr, and more preferably at a pressure of about $5\times10^{-3}$ Torr.

In the embodiment shown in FIG. 3, which represents a triple quadrupole MS analyser 10', ions from source 12 can then be passed into third multipole rod set 100, 35, Q3, for example a quadrupole rod set via an exit lens 40 as they leave chamber 32. Pressure in the Q3 region may be the same as that for Q1, namely 1 to $3\times10^{-5}$ Torr. In the illustrated embodiments a detector 76 is provided for detecting ions exiting through the exit lens 40.

The positive ions thus provided in multipole rod set 100, Q3, 35 or in Q2, are joined by negative ions from negative ion source 150, introduced from a side of the Q3 or Q2 rod set 35/32 from, for example, an atmospheric sampling glow discharge ion source (ASGDI), as described in detail in, for example, in J. Wu et al., "Positive Ion Transmission Mode Ion/Ion Reactions in a Hybrid Linear Ion Trap", Analytical Chemistry 2004, 76, 5006-5015; and S. McLuckey et al., "Atmospheric Sampling Glow-Discharge Ionization Source for the Determination of Trace Organic-Compounds in Ambient Air, Analytical Chemistry 1988, 60, 2220-2227; each of which is incorporated herein by this reference.

Multipole rod set Q3 or Q2 (35 or 32), is coupled to AC/RF power supply(ies) 104, 106 in order to be provided with AC and RF current/voltages as described herein, and may thereby be operated so as to contain both anions and cations simultaneously. Reactions may take place in either Q3 and/or Q2. In fact, the latter may be desirable for several reasons. For example, there may be collisional cooling in Q2, and it may be relatively easy to stop and cool ions there; and for example rod set Q3, 35, may be configured for use as, for example, a mass filter or as a linear ion trap (LIT) with mass-selective axial ejection.

In the embodiment shown in FIG. 2, which represents a QqTOF instrument, mass spectrometer 10 further comprises lens 129 and TOF mass analyzer 130. As ions leave chamber 30, they are passed through a focusing lens 129 and aperture 128 into ion extraction zone 134 defined by lower plate 137 and window 135 of the TOF analyzer 130. Ions moving slowly through extraction zone 134 are pushed through window 135 and into main chamber or flight tube 144 by use of electrical pulses applied at plate 138 and grid 136, and by voltage applied to accelerating column 138. Ion mirror 140 may be provided at the distal end of TOF analyzer 130, and detector 142 as shown.

Under the influence of electrical fields provided at grids 135, 136 and accelerating column 138, ion packets 146 may be accelerated toward ion mirror 140 and then into detector 142, as indicated by arrow 150. As will be understood by those skilled in the relevant arts, mass-charge (m/z) ratios of ions in packets 146 may be determined by measuring their arrival time to detector 142.

A particular advantage offered by the applicants' teachings for TOF mass analyzers is that the application of RF and AC fields as described herein can be used to prevent the presence of oscillating potentials in the region beyond the exit from the corresponding rod set (e.g., rod set 100, Q2 in FIG. 2), and thus to prevent energy spread of ions and related difficulties in transferring ions to the TOF mass analyzer.

In FIG. 3, multipole rod set Q3, 35, is coupled to AC/RF power supply(ies) 104, 106 in order to be provided with AC and RF current/voltages as described herein, and may thereby be operated so as to contain both anions and cations simultaneously. Thus rod set Q3, 35, may be configured for use as, for example, a mass filter or as a linear ion trap (LIT) with mass-selective axial ejection.

In the embodiments shown in FIGS. 2 and 3, mass spectrometers 10, 10' further comprise controller 160. Controller 160 may be adapted for receiving, storing, and otherwise processing data signals acquired or otherwise provided by mass spectrometer 10, 10' and associated devices. Controller 160 may further provide a user interface suitable for controlling MS systems 10, 10', including for example input/output devices suitable for accepting from user(s) of the systems and implementing system commands. In particular, controller 160 may be adapted for processing data acquired by detectors 142, 76, and providing to mass spectrometers 10, 10' command signals determined at least in part by the processing of such data.

Any one or more of power supplies 36, 37, 38, 104, 106, and therefore currents/voltages at electrodes of devices 100, Q0, ST, Q1, Q2, Q3 and at IQ1, IQ2, and IQ3; curtain gas pressures provided at 18; and pressures provided at chambers 21, 26, 30, and 32; as well as any one or more components of mass analyzers 130, 76 may be automatically controlled, in whole or in part, by controller 160, as described herein, to accomplish the purposes described herein.

As will be understood by those skilled in the relevant arts, controller 160 can comprise any data-acquisition and processing system(s) or device(s) suitable for accomplishing the purposes described herein. Controller 160 can comprise, for example, a suitably-programmed or—programmable general—or special-purpose computer, or other automatic data processing devices. Controller 160 can be adapted, for example, for controlling and monitoring ion detection scans conducted by mass spectrometers 10, 10'; and for acquiring and processing data representing such detections by mass spectrometers 10, 10' of ions provided source 13 and collision chamber 32, as described herein. Accordingly, controller 160 can comprise one or more automatic data processing chips adapted for automatic and/or interactive control by appropriately-coded structured programming, including one or more application and operating systems, and by any necessary or desirable volatile or persistent storage media. As will be understood by those of ordinary skill in the relevant arts, a wide variety of processors and programming languages suitable for implementing the applicants' teachings are now available commercially, and will doubtless hereafter be developed. Examples of suitable controllers, comprising suitable processors and programming, are those incorporated in the API 5000™ or API 4000™ MS systems available through Applied Biosystems/MDS Sciex.

Power supplies 37, 36, 38, 104, 106 are provided for providing various RF, AC and DC voltages to the various quadrupoles are provided, as disclosed herein. Q0 may, for example, be operated as an RF-only multipole ion guide Q0 whose function is to cool and focus the ions as taught for example in U.S. Pat. No. 4,963,736. Q1 can be employed as a standard resolving RF/DC quadrupole. The RF and DC voltages provided by power supplies 37, 36 may be chosen to transmit only precursor ions of interest, or ions of desired ranges of m/z, into Q2. Q2 may be supplied with collision gas from source 34 to dissociate or fragment precursor ions to produce first or subsequent generations of fragment ions. DC voltages may also be applied (using one or more of the aforementioned power sources or a different source) on the electrodes IQ1, IQ2, IQ3 and the exit lens 40. Moreover, RF and AC voltages/currents may be applied to any of the rod sets 100, Q0, ST, Q1, Q2, Q3 as described herein in order to contain and/or guide ions of both charge states.

All of the DC, AC, and RF voltages applied to the various rod sets 100, Q0, ST, Q1, Q2, Q3 may be controlled by a human user of the MS system 10, 10'using the controller 160 and appropriate input/output devices. Controller 160 may be adapted to implement instructions received from such a user in fully or semi-automatic fashion.

As will be appreciated by those skilled in the relevant arts, once they have been made familiar with this disclosure, any one or more of rod sets 100, Q0, ST, Q1, Q2, Q3 can be employed for containment of ions of both charge states by suitable application of RF and AC currents/voltages as described herein. As will further be appreciated by such artisans, points of introduction and sources 12, 150 for anions and cations my be reversed or otherwise modified in accordance with the applicants' teachings.

While the applicants' teachings have been described and illustrated in connection with preferred embodiments, many variations and modifications, as will be evident to those skilled in the relevant arts, may be made without departing from the spirit and scope of thereof; and the applicants' teachings are not to be limited to the precise details of methodology or construction set forth above as such variations and modifications are intended to be included within the scope of their teachings. Except to the extent necessary or inherent in the processes themselves, no particular order to steps or stages of methods or processes described in this disclosure, including the Figures, is implied. In many cases the order of process steps may be varied without changing the purpose, effect, or import of the methods described.

It will be appreciated by those skilled in the relevant arts, from a reading of the disclosure, that various changes in form and detail can be made without departing from the true scope of the invention in the appended claims.

Section headings used herein are provided for organizational purposes only, and are not to be construed as limiting the subject matter described in any way.

What is claimed is:

1. A method of confining ions of opposite polarity within a single volume, the method comprising:

providing to an elongated multipole rod set comprising a plurality of 2N electrodes, where N is an integer greater than one, a radio-frequency (RF) voltage, the RF voltage applied in a first phase to every second rod and in an opposite phase to the remaining rods;

providing to the rod set, in addition to the RF voltage, an alternating current (AC) voltage the AC frequency being the same or a lower frequency than the RF frequency, and being applied in a substantially single phase to all rods of the rod set; and providing ions of opposite polarity within a region bounded by the rod set.

2. A method of operating a mass spectrometer having an elongated multipole rod set comprising a plurality of opposing electrode sets, the method comprising:

providing a radio-frequency (RF) voltage to at least two of the electrodes;

providing an alternating current (AC) voltage to the rod set in addition to the RF voltage, the AC frequency being the same or lower than the RF frequency and being applied in a substantially single phase and at substantially uniform voltage to all rods of the rod set; and providing ions of opposite polarity within a region bounded by the rod set.

3. The method of claim 2, wherein the AC frequency is lower than the RF frequency.

4. The method of claim 3, wherein the AC frequency is less than or equal to one-half of the RF frequency.

5. The method of claim 2, wherein the multipole rod set comprises an even number of rods.

6. The method of claim 2, wherein the RF voltage is applied in opposite phases on at least two of the opposing electrode sets.

7. A mass spectrometer system comprising:

a multipole rod set comprising a plurality of 2N electrodes, where N is an integer greater than one;

a radio-frequency (RF) voltage supply configured to apply an RF voltage in a first phase to every second rod and in an opposite phase to the remaining rods;

an alternating current (AC) voltage supply connected to the electrode sets;

wherein the AC and RF voltage supplies are independently controllable and the AC voltage supply is configured to provide a substantially single-phase AC voltage of substantially uniform magnitude to the electrode sets, the AC frequency being the same or a lower frequency than the RF frequency.

8. A mass spectrometer system comprising:

a multipole rod set comprising a plurality of opposing electrode sets;

a radio-frequency (RF) voltage supply connected to at least two of the opposing electrode sets; and an alternating current (AC) voltage supply connected to the electrode sets;

wherein the AC and RF voltage supplies are independently controllable and the AC voltage supply is configured to provide a substantially single-phase AC voltage to the electrode sets.

9. The system of claim 8, wherein the AC voltage supply is adapted to provide AC to the electrode sets at a frequency lower than the frequency of the RF voltage.

10. The system of claim 9, wherein the AC is provided at a frequency less than or equal to one-half of the RF frequency.

11. The system of claim 8, wherein the multipole rod set comprises an even number of rods.

12. The system of claim 8, wherein the multipole rod set comprises an even number of opposing rod sets.

13. The system of claim 8, wherein the RF voltage supply is adapted to provide RF voltage of opposite phase to the at least two opposing electrode sets.

14. The system of claim 8, wherein the RF and AC voltage supplies are powered by the same power supply device.

* * * * *